US005252095A

United States Patent [19]

Breitschaft et al.

[11] Patent Number: 5,252,095

[45] Date of Patent: Oct. 12, 1993

[54] ELECTRICAL CONNECTOR

[75] Inventors: Josef Breitschaft, Prien; Artur Wohlfart, München, both of Fed. Rep. of Germany

[73] Assignee: Siemens Aktiengesellschaft, Munich, Fed. Rep. of Germany

[21] Appl. No.: 838,760

[22] PCT Filed: Apr. 26, 1990

[86] PCT No.: PCT/DE90/00306

§ 371 Date: Mar. 17, 1992

§ 102(e) Date: Mar. 17, 1992

[87] PCT Pub. No.: WO91/06989

PCT Pub. Date: May 16, 1991

[30] Foreign Application Priority Data

Oct. 24, 1989 [DE] Fed. Rep. of Germany ... 8912596[U]

[51] Int. Cl.[5] ..... H01R 13/514

[52] U.S. Cl. ..... 439/752; 439/595

[58] Field of Search ..... 439/595, 752, 839

[56] References Cited

U.S. PATENT DOCUMENTS 4,540,235 9/1985 Lolic ..... 439/839
4,714,437 12/1987 Dyki .
4,867,712 9/1989 Kato ..... 439/752
4,946,399 8/1990 Kawashima ..... 439/752

FOREIGN PATENT DOCUMENTS 8608199 6/1986 Fed. Rep. of Germany .
3537722 1/1988 Fed. Rep. of Germany .
3720751 1/1988 Fed. Rep. of Germany .

*Primary Examiner*—Eugene F. Desmond
*Attorney, Agent, or Firm*—Hill, Steadman & Simpson

[57] ABSTRACT

The electrical connector has contact elements in adjacent contact chambers in an insulating housing (1), each element having a crimping zone for the connection of stranded conductors. In addition, there is provided in the housing in each case one slot (16) for holding a locking strip (31) which interacts with in each case one locking edge (22) of each contact element. In order to avoid the spread strand ends from straying into adjacent contact chambers when the locking strip (31) is inserted at right angles to the longitudinal axis of the contact elements and hence causing a short-circuit, each crimping zone is located on a side of the wall of the partially-tubular contact element (2,102) which is opposite the locking edge.

6 Claims, 2 Drawing Sheets

ELECTRICAL CONNECTOR

BACKGROUND OF THE INVENTION

Such electrical connectors are widely known, for example from German references DE-C-35 37 722 or DE-U-86 08 199. The connector design of the present invention provides that the contact elements, which are bent from sheet metal into a tubular or groove shape, in partial zones, bend upwards from a common base zone. The known connectors of this type are therefore all designed such that the open side of the crimping zone and the locking edge mentioned are constructed on the same side of the wall of the contact element, offset somewhat only in the axial direction.

However, when crimping on a stranded conductor, the case can arise that the ends of the strands project beyond the crimping zone and that the individual wires of the strands are thus spread out to a great extent. The problem then arises that, as a result of the locking strip, which can be part of the top housing, being pushed in, the ends of the strands are looped in the transverse direction over the housing slot into the adjacent contact chamber and then cause a short-circuit with the adjacent contact.

SUMMARY OF THE INVENTION

The object of the invention is to develop an electrical connector of the type mentioned initially such that reliable insulation is ensured between adjacent contact elements and cable cores by means of a locking strip and a top housing, despite an unchanged plug attachment of the contact elements and with locking which is likewise unchanged.

This object is achieved according to the invention in that the recesses and the locking edges, on the one hand, and the open sides of the crimping zones, on the other hand, are provided in each case on mutually opposite sides of the wall of the contact elements, and in that the crimping sections of the inserted contact elements are each located opposite a closed housing wall.

In the connector design according to the invention, the crimping zones thus face away from the locking zones of the contact elements so that the crimping zone thus has a more or less closed sheet-metal wall at the side of the locking edge and of the housing slot, and, on the other hand, faces a closed housing wall with its open side. Thus, even if a stranded conductor is spread at its free end and the free ends of the individual conductors project outwards in a uncontrolled manner, they cannot cause a short-circuit since they are opposite a closed wall region of the insulating housing and, in any case, do not come into contact with the locking strip, which is pushed in at right angles.

In general terms the electrical connector of the present invention for a plurality of stranded conductors has the following features:

a row of adjacent contact chambers is constructed in a housing;

one contact element can be inserted in a latching manner into each of the contact chambers;

each contact element is constructed, at least in partial zones, in a tubular shape and has a crimping zone for the connection of a standard conductor, and a locking edge which is formed by a recess and points in the opposite direction to the insertion direction and the housing has a slot which runs at right angles to the insertion direction of the contact elements and is located above the recesses of the contact elements and into which a locking strip, engaging behind the locking edges of the contact elements can be pushed, the recesses and the locking edges, on the one hand, and the open sides of the crimping zones, on the other hand, are provided in each case on mutually opposite sides of the wall of the contact elements, and the crimping zones of the inserted contact elements are each located opposite a closed housing wall.

Particular configurations and developments of the present invention are as follows. The section cut from the material of the contact element to form the recess is bent into the interior of the contact element as a covering flap. The locking strip is part of a top housing which can be pushed onto the housing from the side. The slot opens into the interior of the housing and the locking strip can be inserted into the housing. The contact element consists of a contact spring, which is bent in the central zone in the form of a groove, and a top spring, which partially surrounds the contact spring. A latching lance, which can latch into a window, is integrally formed on the top spring, the latching lance and the locking edge being arranged on the same side of the wall of the contact element.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, and in which:

DESCRIPTION OF THE PREFERRED EMBODIMENT

Figure 1:
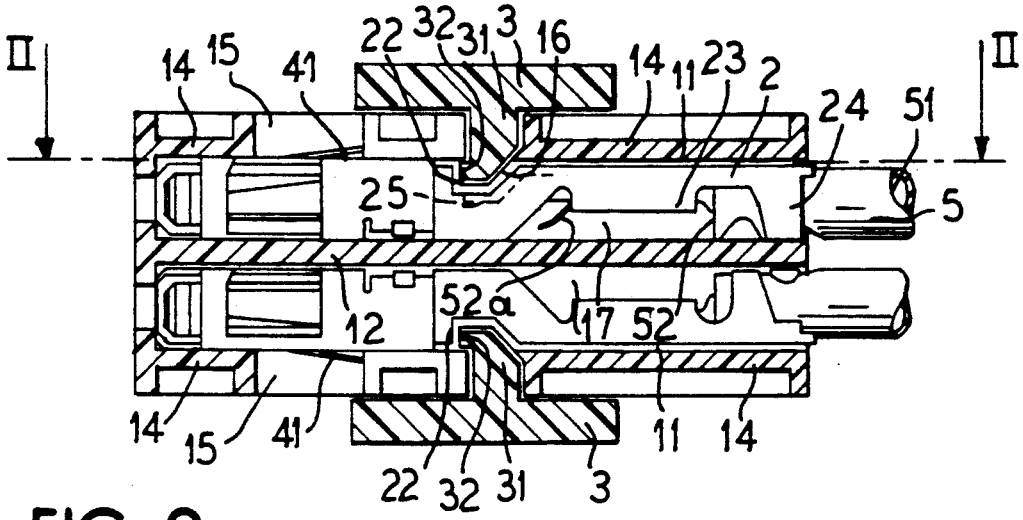
FIGS. 1 and 2 show a first embodiment of an electrical connector according to the invention in two partial sectional views.
Figure 2:
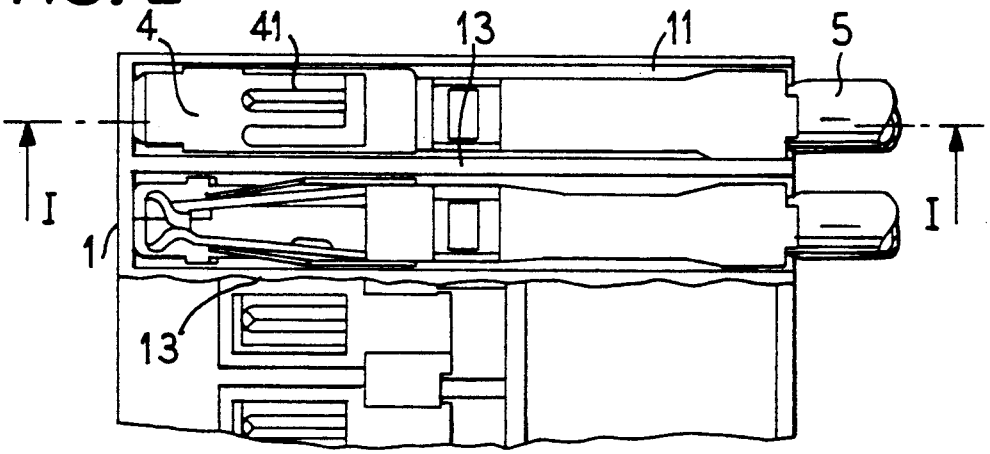

The electrical connector shown in FIGS. 1 and 2 has a housing 1 which has two rows of contact chambers 11, located one above the other. The individual contact chambers, with an essentially rectangular cross-section, are separated from one another by a continuous horizontal wall 12 and by individual vertical walls 13. The contact chambers are likewise closed by walls 14 to the exterior, that is to say to the top and to the bottom, these walls having interruptions, however, as is described in detail later.

One contact element 2, as mentioned, is inserted in the longitudinal direction into each of the individual contact chambers. In this case, a latching lance 41, which is latched in a window 15 of the housing 1, is integrally formed in the front region on each contact element 2. In addition, each contact element has a locking edge 22 which is constructed on the side of the wall of the contact element facing the outer wall 14 of the housing. In the region of these locking edges, the housing has a slot 16 into which a locking strip 31 can be pushed from the side, that is to say at right angles to the longitudinal direction of the contact elements 2. In the example of FIG. 1, the locking strip 31 is part of a top housing 3 which, in a manner known per se, surrounds the complete housing with the two rows of contact chambers and contact elements, located one above the other. By means on its closing edge 32, the locking strip 31 provides a stop for the locking edge 22, already mentioned, of the contact elements and thus provides additional protection therefor against undesired pulling out from the housing.

The contact element 2 has a crimping zone 29, with crimping lugs 23 and securing lugs 24, at one end (at the right-hand end in FIGS. 1 and 2). A core 5 of a strip cable, constructed as insulated strands, is inserted into this crimping zone. In this case, the core, with the insulation 51, is clamped firmly to the securing lugs 24, while the free end of the core 5 is stripped of insulation so that the individual conductors 52 are exposed and are made contact with by means of the bent crimping lugs 23.

The free ends 52*a* of the individual conductors can in this case project beyond the crimping lugs 23 without there being any risk of a short-circuit with an adjacent stranded conductor, since the open side of the crimping zone in the housing 1 in each case points inwards towards the wall 12, so that the free space in which the ends 52*a* of the stranded conductors emerge is closed on three sides in an insulating manner by the walls 12 and 13. In any case, the free ends 52*a* of the stranded conductors cannot be looped into an adjacent contact chamber as a result of the sliding movement of the locking strip 31, since the slot 16 of the housing and the locking edge 22 of the contact elements are located on the opposite side of the wall of the contact elements 2, facing away from the crimping zone. In addition, the zone in the form of a covering flap 25 in the approximately tubular contact element 2, which zone is stamped free from the said contact element, is bent inwards and thus additionally prevents spreading of the strand ends 52*a* into the displacement zone of the locking strip 31.

Figure 3:
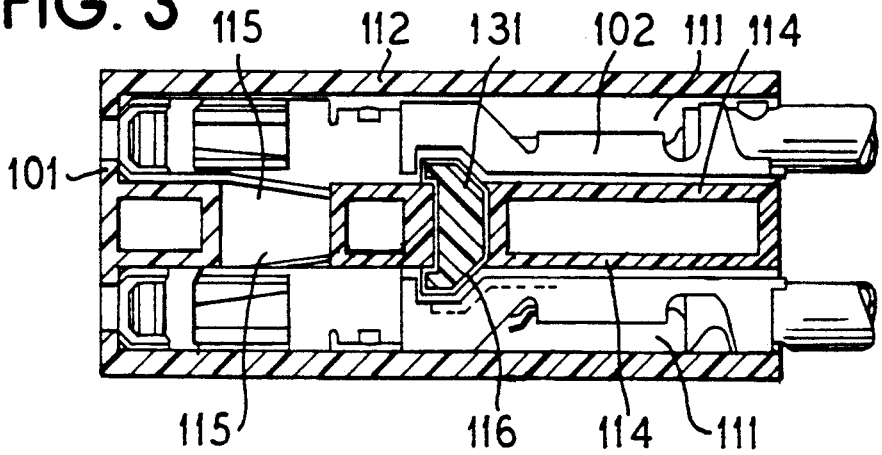
FIG. 3 shows a further embodiment of an electrical connector in a sectional view corresponding to FIG. 1, FIGS. 4 to 6 show a contact spring for the electrical connector of FIG. 1 in three views.

FIG. 3 shown an embodiment which is somewhat modified in comparison with FIG. 1. In this case, a housing 101 having two rows of contact chambers 111 is constructed such that the contact chambers in each case have walls 112, closed to the outside, and walls 114, which are perforated inwardly. Windows 115, for holding the latching lances 41, and slots 116, for insertion of a locking strip 131, are constructed in each of these walls 114. In this example, this locking strip 131 is constructed as an individual part, that is to say it is not a component of a top housing. The contact elements 102 are constructed in an identical manner to the contact elements 2 in FIG. 1; they are merely inserted rotated through 180° in comparison with this figure.

Figure 4:
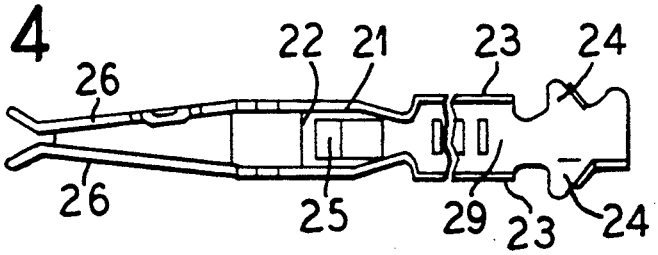
Figure 5:
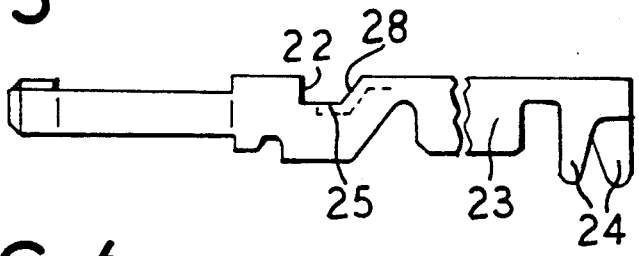
Figure 6:
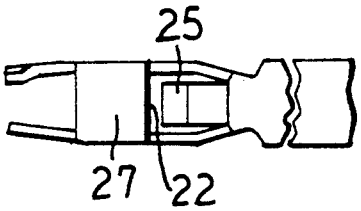

The construction of the contact elements is explained in somewhat more detail in the following text. These contact elements in FIG. 1, 2 or 3 in each case consist of a contact spring 21 and a top spring 4. The contact spring 21, shown in three different views in FIGS. 4, 5 and 6, is bent, essentially in the shape of a groove, from sheet metal. In this case, the already-mentioned crimping lugs 23 and the securing lugs 24 are constructed at the terminal end. The locking edge 22 is stamped free in the central zone 27, the flap 25, which is cut free, being bent downwards as a covering flap. The contact end opposite to the terminal end is formed to produce plug springs 26 (not shown in FIG. 6).

Figure 7:
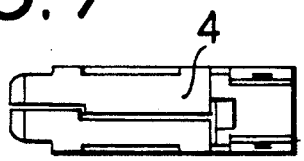
FIGS. 7 to 9 show a top spring for the contact spring of FIGS. 4 to 6, likewise in three views.
Figure 8:
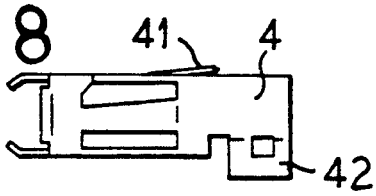
Figure 9:
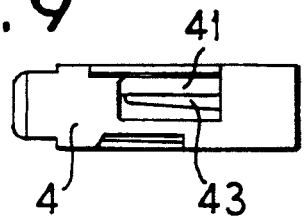

The top spring 4, which is shown in FIGS. 7 to 9 in the same views corresponding to the representation of the contact springs in FIGS. 4 to 6, is bent to form a plug tube with an approximately rectangular cross-section and is crimped onto the contact region of the contact spring. The crimping lugs 42, which engage over the central zone 27 of the contact spring 21, are used for this purpose. The already-mentioned latching lance 41, which is provided with a bead 43 for reinforcement, is bent out upwards from this top spring 4.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electrical connector for a plurality of stranded conductors, comprising:

a row of adjacent contact chambers in a housing; one respective contact element of a plurality of contact elements insertable in a latching manner into each of the contact chambers;

each contact element, at least in partial zones thereof, having a tubular shape and a crimping zone for connection of a stranded conductor, and a locking edge which is formed by a recess that points in an opposite direction to an insertion direction of each contact element into a respective contact chamber; and the housing having a slot which runs at right angles to the insertion direction of the contact elements and which is located above the recesses of the contact elements and into which a locking strip is inserted, engaging behind the locking edges of the contact elements;

respective recesses and respective locking edges of the contact elements, and respective open sides of respective crimping zones of the contact elements being located on mutually opposite sides of respective walls of the contact elements; and the housing having closed wall structures such that for each of the contact chambers an inserted contact element has the crimping zone thereof surrounded by a respective closed wall structure, the crimping zones of inserted contact elements thereby being completely isolated from one another.

2. The electrical connector according to claim 1, wherein the slot opens into the interior of the housing and wherein the locking strip is inserted into the housing.

3. The electrical connector according to claim 1, wherein the contact element has a contact spring, which is bent in a central zone of the contact element in the form of a groove, and a top spring, which partially surrounds the contact spring, and wherein a latching lance, which latches into a window in the housing, is integrally formed on the top spring, the latching lance and the locking edge being arranged on the same side of the wall of the contact element.

4. The electrical connector according to claim 1, wherein a section cut from the material of the contact element to form the recess is bent into an interior of the contact element as a covering flap.

5. An electrical connector for a plurality of stranded conductors, comprising:

a row of adjacent contact chambers in a housing; one respective contact element of a plurality of contact elements insertable in a latching manner into each of the contact chambers;

each contact element, at least in partial zones thereof, having a tubular shape and a crimping zone for connection of a stranded conductor, and a locking edge which is formed by a recess that points in an opposite direction to an insertion direction of each contact element into a respective contact chamber;

the housing having a slot which runs at right angles to the insertion direction of the contact elements and which is located above the recesses of the contact elements and into which a locking strip is inserted, engaging behind the locking edges of the contact elements;

respective recesses and respective locking edges of the contact elements, and respective open sides of respective crimping zones of the contact elements being located on mutually opposite sides of respective walls of the contact elements;

crimping zones of the inserted contact elements being each located opposite a closed housing wall of the housing; and a section cut from the material of the contact element to form the recess being bent into an interior of the contact element as a covering flap.

6. An electrical connector for a plurality of stranded conductors, comprising:

a row of adjacent contact chambers in a housing; one respective contact element of a plurality of contact elements insertable in a latching manner into each of the contact chambers;

each contact element, at least in partial zones thereof, having a tubular shape and a crimping zone for connection of a stranded conductor, and a locking edge which is formed by a recess that points in an opposite direction to an insertion direction of each contact element into a respective contact chamber;

the housing having two mutually opposed slots which run at right angles to the insertion direction of the contact elements and which are located above recesses of respective contact elements and into which respective locking strips are inserted, engaging behind respective locking edges of the contact elements;

respective recesses and respective locking edges of the contact elements, and respective open sides of respective crimping zones of the contact elements being located on mutually opposite sides of respective walls of the contact elements; and the housing having closed wall structures such that for each of the contact chambers an inserted contact element has the crimping zone thereof surrounded by a respective closed wall structure, the crimping zones of inserted contact elements thereby being completely isolated from one another;

each of the locking strips being part of a top housing which engages the housing from a side thereof.

* * * * *